United States Patent [19]

Dammann et al.

[11] 4,402,179

[45] Sep. 6, 1983

[54] YARN FALSE TWISTING APPARATUS HAVING IMPROVED THREAD-UP CAPABILITY

[75] Inventors: Peter Dammann, Remscheid; Benno Frank, Wuppertal, both of Fed. Rep. of Germany

[73] Assignee: Barmag Barmer Maschinenfabrik AG, Fed. Rep. of Germany

[21] Appl. No.: 272,938

[22] Filed: Jun. 12, 1981

[30] Foreign Application Priority Data

Apr. 9, 1981 [DE] Fed. Rep. of Germany ..... 3114302

[51] Int. Cl.[3] ..... D02G 1/04; D02G 1/08

[52] U.S. Cl. ..... 57/336; 57/334; 57/339

[58] Field of Search ..... 57/334–340, 57/348, 349, 280

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes

*Attorney, Agent, or Firm*—Bell, Seltzer, Park & Gibson

[57] ABSTRACT

A yarn false twisting apparatus is disclosed which comprises two rotating twist imparting members, with a pressure applying member comprising a cylinder-piston assembly positioned to bias one member toward the other at the twisting zone. The apparatus includes an improved yarn thread-up capability which avoids breakage when the yarn is initially twisted, and which includes a pressurized air supply system for biasing the piston of the pressure applying member into operative contact with the adjacent twist imparting member, and control means for substantially reducing the pressure during yarn thread-up to thereby limit the nipping force applied to the yarn. In one embodiment, the air supply system includes a reservoir for cushioning the application of the pressure on the piston to thereby avoid the rapid application of a nipping force on the newly threaded yarn.

11 Claims, 4 Drawing Figures

YARN FALSE TWISTING APPARATUS HAVING IMPROVED THREAD-UP CAPABILITY

Figure 1A:
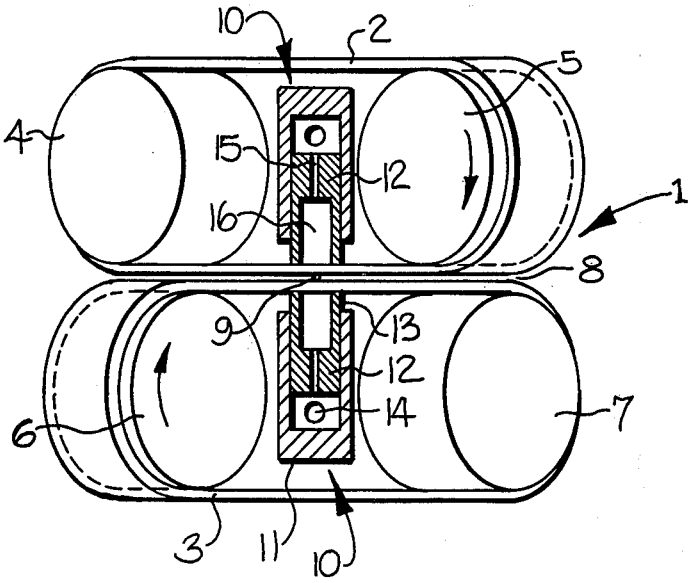

The present invention relates to an improved yarn false twisting apparatus, of the type disclosed in commonly owned copending U.S. applications Ser. Nos. 168,734 and 168,735, both filed on July 14, 1980. Application Ser. No. 168,734 is now U.S. Pat. No. 4,339,915, and application Ser. No. 168,735 is now abandoned in favor of application Ser. No. 219,329, filed on Dec. 22, 1980, now U.S. Pat. No. 4,377,932.

In copending U.S. application 168,734, there is disclosed an apparatus for false twisting a yarn which comprises a thin flexible or pliable disc mounted for rotation with a cooperating disc or roller to define a twisting zone between opposing direction surfaces thereof. A pressure applying member is mounted adjacent the back face of the flexible disc for biasing the disc toward the other member locally at the twisting zone so as to firmly engage the yarn passing through the twisting zone, and while the friction surfaces remain in substantially non-contacting relationship with respect to each other. As a result, the yarn contacts the friction surfaces only in the narrowly limited and defined twisting zone. One particular advantage of this prior false twisting apparatus is the fact that the apparatus not only twists the yarn, but also effects its conveyance through the twisting zone.

In copending U.S. application Ser. No. 168,735, there is disclosed a friction false twisting apparatus which comprises a pair of endless belts mounted for rotation to define a twisting zone between opposing friction surfaces thereof. A pressure applying member is mounted adjacent the back of at least one of the belts for biasing the belt toward the other belt locally at the twisting zone and so as to firmly engage the yarn passing therethrough.

According to the above applications, it was also possible for both of the cooperating twist imparting members to consist of flexible discs or endless belts, each of which is acted upon by a separate pressure applying member which presses against its rear surface and upsets the flexible members toward the thread line at the twisting zone. It has also been proposed to mount one of the discs on a gimbal bearing relative to its drive shaft, so as to locally bias the disc against the cooperating friction surface at the twisting zone, note for example German patent application No. P 3023887 and corresponding U.S. application Ser. No. 272,936, filed June 12, 1981.

Such prior false twisting apparatus often present a problem during thread-up of the yarn, in that the initial application of the twist causes the yarn to shorten, which rapidly increases the yarn tension and sometimes causes the yarn to break.

It is accordingly an object of the present invention to provide a method and apparatus for threading a yarn in a friction false twist apparatus of the described type, which is structurally and technically simple, and which effectively alleviates the problem of initial yarn breakage. In this regard, it is understood that the term "yarn" as used herein is intended to include strands of fibers or endless monofilament or multifilament strands of synthetic, linear high polymers.

It is a further object of the present invention to facilitate the thread-up of a yarn in a false twist apparatus of the described type, and in particular, a relatively weak, low denier yarn, without breakage.

In accordance with the present invention, a method and apparatus are provided wherein the false twist level is reduced at the start of the texturing operation and after the thread-up procedure, to thereby avoid a rapid yarn shortening resulting from the application of twist, as well as an undue increase in tension. More particularly, for the purpose of facilitating the threading of the yarn into the twisting zone formed between the friction surfaces, the contact pressure exerted by the pressure applying means is at least temporarily substantially reduced from its normal operating value, and is increased back to its normal value after the yarn has been threaded up. The normal operating value is here understood to mean the contact pressure at which the pressure applying member is biased during operation, taking into account the overall operating conditions, such as yarn denier, operating speed, twist level, etc., and at which a uniformly good crimping result may be achieved while wear of the friction surfaces is minimized.

By the above arrangement, the normal force acting on the yarn is reduced, and the slip between the friction surfaces and the yarn is increased, so that there is either no false twist action, or only very little twisting.

As a further aspect of the specific method of the present invention, it is possible to either apply a specified reduced contact pressure, or to reduce the pressure before threading up the yarn, and then let it again slowly rise until the intended operating pressure has been restored.

The pressure applying member may comprise a cylinder-piston assembly, such as described in the above noted U.S. patent applications Ser. Nos. 168,734 and 168,735, and the pressure fluid acting on the piston can be freely exhausted, preferably by a throttling device, or it may be exhausted into a pressure fluid reservoir while the yarn is threaded in the false twisting apparatus. Thereafter the operating pressure may be restored to normal.

Figure 1B:
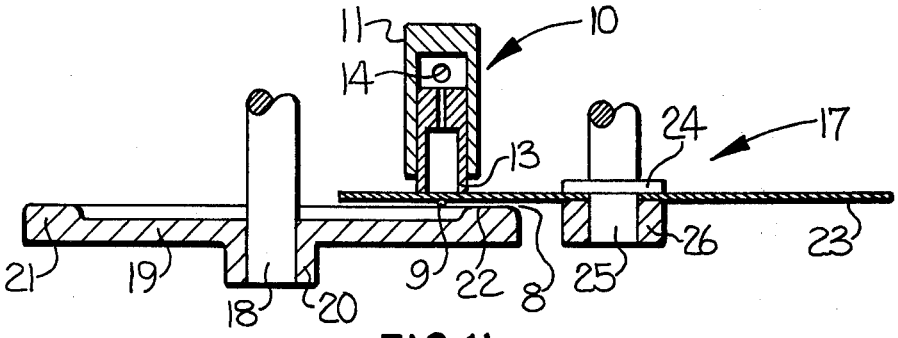
Figure 2:
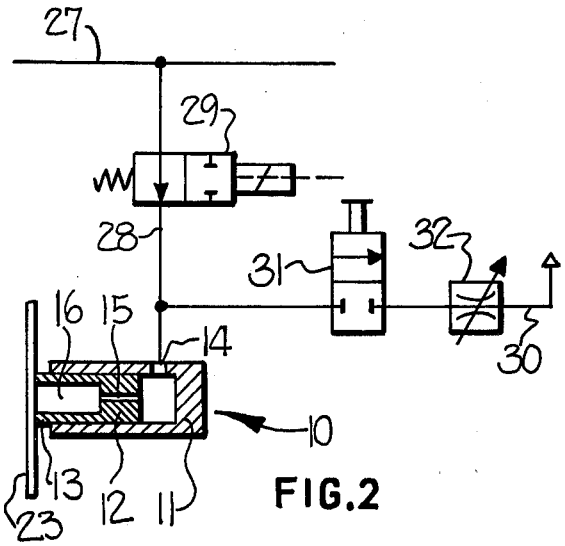
Figure 3:
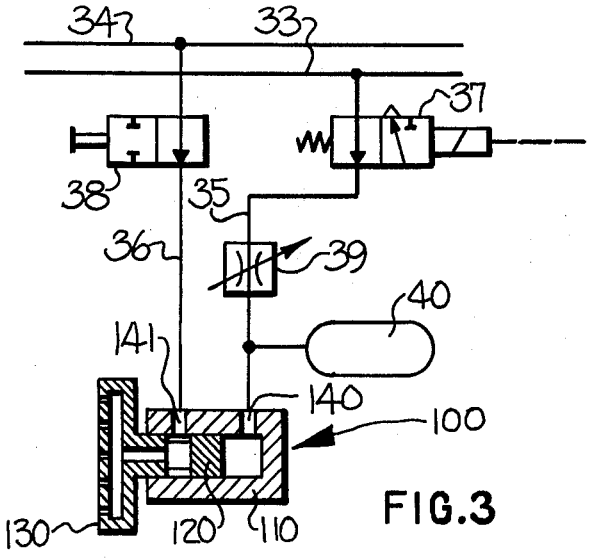

Some of the objects and advantages of the invention having been stated, others will appear as the description proceeds, when taken in connection with the accompanying drawings, in which:

FIG. 1*a* is a schematic illustration of a friction false twisting apparatus comprising a pair of cooperating endless belts, and with a pressure applying member pressing against the rear side of each belt;

FIG. 1*b* is a schematic illustration of a friction false twisting apparatus in the form of a pair of circular discs, and with a pressure applying member pressing against the rear side of the flexible disc;

FIG. 2 is a schematic illustration of the control means for the pressure applying member in accordance with one embodiment of the present invention, and which has provision for reducing the contact pressure when the yarn is threaded in the false twist apparatus; and FIG. 3 is a schematic illustration of a modified embodiment of the control means and pressure applying member, and which has provision for the gradual increase of the pressure when the yarn is threaded.

Referring more particularly to the drawings, FIG. 1*a* schematically illustrates a friction false twisting apparatus consisting of crossing belts or belt assemblies 2, 3, of the type further illustrated in copending U.S. application Ser. No. 168,735. The belt assembly 2 is rotatably driven by the mounting pulleys 4, 5, and the belt assembly 3 is driven by the pulleys 6, 7. Both belt assemblies 2 and 3 are angled with respect to each other at an adjustable angle, which determines the ratio of twist to yarn conveyance. In addition, the belts are positioned to form a narrow gap 8, in which the yarn 9 is nipped and false twisted.

Both belt assemblies 2 and 3 are adapted to be pressed against the circumference of the yarn 9 by pressure applying members 10 which are operatively positioned adjacent the crossing area. Preferably, the pressure applying members 10 consist of a cylinder 11 and piston 12, with the piston 12 having a transverse face at the end inside the cylinder, and a contact pressure plunger or skirt 13 at the opposite end and which has an outline adapted to the thread line in the crossing area. It is preferred that the cylinder-piston assembly be so designed that a portion of the pressurized fluid supplied to the connection 14 can flow via a narrow passage 15 in the piston 12 into a space 16 at the front edge of the skirt 13 and form a pressurized fluid cushion between the skirt 13 and the rear side of the associated belt. The pressure fluid, which is preferably air, emerges from the space 16 and may be described as "lubricating air," since it serves the purpose of reducing friction and wear between the skirt 13 and the adjacent belt.

FIG. 1*b* schematically illustrates a disc assembly 17, of the type further described in U.S. application Ser. No. 168,734. This assembly consists of an essentially rigid disc 19 rotatably driven with its shaft 18. The disc has a hub 20 and a unitary elevated rim 21. A friction surface 22 which may consist of a proven frictional coating, is applied to the front face of rim 21, or the surface of the disc 19 itself may serve as the friction surface if the material has adequate frictional properties or is able to be surface treated to obtain such properties. The other disc 23 is relatively thin and flexible, and is made of a tension resistant material such as a synthetic rubber mixture. The disc 23 is mounted by the nut 26 against shoulder 24 of its drive shaft 25.

The friction surfaces of the disc assembly 17 are axially arranged so that they form a gap to nip the yarn 9 therebetween. In addition, the flexible disc 23 is biased by the pressure applying member 10, locally on its back side and against the yarn 9 and rim 22 of the rigid disc 19, so that in operation, the yarn 9 is both advanced and false twisted.

FIG. 2 schematically illustrates a control system for the fluid which is supplied to the pressure applying members 10 for a friction false twist unit 1 or 17 as illustrated in FIGS. 1*a* and 1*b*. The supply line 27 leads from a suitable pressurized fluid source (not shown), and a branch line 28 is provided for supplying the pressurized fluid to the cylinder-piston assembly. This branch line contains a first cut off valve 29, preferably an electromagnetic valve which is activated by a yarn detector (not shown) or manually by a switch. Between the cut off valve 29 and the connection 14 on the cylinder 11, there is provided a relief line 30 branching off from the branch line 28, with the line 30 leading to a second cut off valve 31 connected in series with a throttling device 32. The throttling device 32 may be in the form of a fixed restriction, or it may be adjustable. Relief line 30 terminates by opening into the atmosphere or into a pressureless tank.

When a yarn break occurs, the valve 29 will be closed to avoid having the friction surfaces pressed together without a yarn therebetween. Re-threading of the unit 1 or 17 begins by opening relief valve 31 and applying the yarn to the discs. After the yarn has been re-threaded, the valve 29 is opened to again supply the pressure and lubricating fluid. In the branch line 28 between the main supply line 27 and the relief line 30, there is a pressure gradient in the flow of the fluid, by reason of the friction at the wall. By discharging part of the volume of the fluid through the relief line 30 in the branch line 28, the throughput rises and the pressure thereby drops. Thus the static pressure at the rear face of the piston 12 is reduced and a substantially reduced contact pressure is exerted on the rear side of the associated disc or belt. However, $\varepsilon$ portion of the fluid preferably continues to flow through the line 28 into the cylinder and through the passage 15 and space 16 to lubricate the front edge of the skirt 13. Thus the force exerted on the friction false twisting unit and the yarn 9 is reduced to a level controlled by the throttling device 32 so that the slip between the yarn and the friction surfaces increases. Further, when the yarn 9 is threaded, the friction false twist apparatus 1 or 17 provides very little of its characteristic conveying force, and also, the twist that is imparted is substantially reduced. It should be noted that the selection of the throttle 32, or the adjustment thereof, permits the working pressure and thus the contact pressure and false twist level, to be adapted to the desired operational conditions.

After the yarn 9 has been threaded in the friction false twist apparatus 1 or 17, the valve 31 is again actuated, and the fluid is again applied at full pressure to the pressure applying mechanism. Thus the full normal value of the contact pressure and the desired twist level are reached.

FIG. 3 illustrates a modified control system for a cylinder-piston assembly 100 having separate pressure fluid ports 140, 141 for the contact pressure and the lubricating fluid. Here, the lubricating fluid remains connected at all times, while the contact pressure fluid supply is manipulated to reduce the contact pressure of the false twist apparatus when the yarn is to be threaded. The fluid is supplied via separate supply lines 33, 34, with branch lines 35, 36 leading to each of the individual members 100 of the machine. The branch lines 35, 36 contain electromagnetic valves 37, 38 respectively. When the valve 37 closes, the downstream section of the line 35, including the cylinder 110, is vented. The valve 38 is normally open when the motor for the friction false twist unit 1 or 17 is operating, and only the operating personnel can shut it by manually actuating a suitable switch.

An adjustable throttling device 39, and a fluid reservoir 40 are positioned in the line 35 downstream of the valve 37, and the line 35 thereafter leads to the pressure port 140 in the cylinder 110. The second line 36 leads from fluid supply line 34 to the pressure port 141 in the cylinder 110 which is positioned forwardly of the piston face. The port 141 is positioned to communicate with an air distribution passageway in the piston and which exits at the free end 130, to supply the lubricating fluid between the piston and adjacent disc or belt.

Typically, a yarn break or the like, which is signalled by a yarn detector, precedes the threading of the yarn in the friction false twist apparatus 1 or 17. By actuating valve 37, the flow of contact pressure fluid in line 35 is stopped, and line 35 is vented through valve 37, to release the pressure acting against the face of the piston 120. When the yarn is to be re-threaded, valve 37 is reopened. However, the pressure fluid acting on the piston 120 becomes effective only after a period of time, i.e., only when the pressure fluid being adjustably supplied through throttling device 39 has refilled the reservoir 40 and the pressure has been equalized. During that period of time, when the contact pressure of the piston on the friction false twisting apparatus and on the yarn is substantially reduced, the operating personnel may take the necessary action for rethreading the yarn. During the entire threading procedure, the supply of lubricating fluid through the line 36, which in the present embodiment acts independently of the contact pressure, remains operative.

In the drawings and specification, there has been set forth a preferred embodiment of the invention and although specific terms are employed, they are used in a generic and descriptive sense only and not for purposes of limitation.

That which is claimed is:

1. A yarn false twisting apparatus comprising a frame, a pair of twist imparting members, each having a generally flat yarn engaging friction surface, and with at least one of the members being readily flexible in a direction perpendicular to its friction surface, means mounting said members to said frame for rotational movement wherein portions of the respective yarn engaging friction surfaces are disposed in opposing relationship and define a twisting zone therebetween, drive means for operatively rotating each of said members, and such that a yarn may be advanced along a path of travel through said twisting zone while having twist imparted thereto, biasing means operatively mounted adjacent at least said one flexible twist imparting member for biasing said one member toward the other member at said twisting zone, said biasing means comprising a cylinder mounted on the side of said one member opposite its yarn engaging friction surface and aligned with said twisting zone, a piston slidably mounted in said cylinder and having a face at one end and a free opposite end which is positioned to directly overlie said twisting zone, and fluid supply means including a branch line leading into said cylinder for conveying a fluid under pressure into said cylinder to act against the face of said piston to bias the free end thereof into operative contact with the adjacent surface of said one flexible member and thereby bias the same toward said other member at said twisting zone and nip the yarn advancing therethrough, and control means operatively associated with said biasing means for selectively substantially reducing the pressure of said fluid supply means acting upon said piston face, to thereby facilitate the thread-up of said apparatus by limiting the nipping force applied to the yarn, said control means including a relief line connected to said branch line, and a valve positioned in said relief line, whereby opening the valve in said relief line acts to at least substantially reduce the pressure acting upon the face of said piston.

2. The yarn false twisting apparatus as defined in claim 1 wherein the free end of said piston is in the form of an open skirt, and said piston includes a passage extending from said face axially therethrough for directing fluid into the interior of said skirt, and thereby providing a lubricating fluid cushion between the skirt and adjacent surface of said one flexible twist imparting member.

3. The yarn false twisting apparatus as defined in claim 2 further comprising an adjustable throttle positioned in series with said valve in said relief line, whereby the pressure acting upon the face of said piston and passing through said passage in said piston may be adjusted upon opening of said valve.

4. A yarn false twisting apparatus comprising a frame, a pair of twist imparting members, each having a generally flat yarn engaging friction surface, and with at least one of the members being readily flexible in a direction perpendicular to its friction surface, means mounting said members to said frame for rotational movement wherein portions of the respective yarn engaging friction surfaces are disposed in opposing relationship and define a twisting zone therebetween, drive means for operatively rotating each of said members, and such that a yarn may be advanced along a path of travel through said twisting zone while having twist imparted thereto, biasing means operatively mounted adjacent said at least one flexible twist imparting member for biasing said one member toward the other member at said twist zone, said biasing means comprising a cylinder mounted on the side of said one member opposite its yarn engaging friction surface and aligned with said twisting zone, a piston slideably mounted in said cylinder and having a face at one end and a free opposite end which is positioned to directly overlie said twisting zone, and fluid supply means including first line means for conveying a fluid under pressure into said cylinder to act against the face of said piston to bias the free end of said piston into operative contact with the adjacent surface of said one flexible member and thereby bias the same toward said other member at said twisting zone and nip the yarn advancing therethrough, and second line means for conveying the fluid between said free end of said piston and the adjacent surface, and so as to form a fluid cushion therebetween, and control means operatively associated with said biasing means for selectively substantially reducing the pressure in said first time means, to thereby facilitate the thread-up of said apparatus.

5. The yarn false twisting apparatus as defined in claim 4 wherein said first line means includes a first fluid line leading from a pressurized fluid source into said cylinder rearwardly of said piston face, and said second line means includes a second fluid line leading from a pressurized fluid source into said cylinder forwardly of said piston face and communicating with an air distribution passageway in said piston which exits at the free end thereof.

6. The yarn false twisting apparatus as defined in claim 5 wherein said control means includes a relief valve in said first fluid line for selectively releasing the pressure therein.

7. The yarn false twisting apparatus as defined in claim 6 wherein said first fluid line further includes a fluid reservoir positioned downstream of said relief valve for cushioning the initial application of the pressure to said piston and thus the yarn.

8. The yarn false twisting apparatus as defined in claim 6 or 7 wherein said first fluid line further includes a throttling valve to adjustably control the pressure therein.

9. The yarn false twisting apparatus as defined in claim 5, 6 or 7 wherein said second fluid line includes a relief valve for selectively releasing the pressure therein, and such that the pressure may be maintained in said second fluid line independently of the pressure in said first fluid line.

10. A yarn false twisting apparatus comprising a frame, a pair of twist imparting members, each having a generally flat yarn engaging friction surface, and with at least one of the members being readily flexible in a direction perpendicular to its friction surface, means mounting said members to said frame for rotational movement wherein portions of the respective yarn engaging friction surfaces are disposed in opposing relationship and define a twisting zone therebetween, drive means for operatively rotating each of said members, and such that a yarn may be advanced along a path of travel through said twisting zone while having twist imparted thereto, biasing means operatively mounted adjacent at least said one flexible twist imparting member for biasing said one member toward the other member at said twisting zone, said biasing means comprising a cylinder mounted on the side of said one member opposite its yarn engaging friction surface and aligned with said twisting zone, a piston slideably mounted in said cylinder and having a face at one end and a free opposite end which is positioned to directly overlie said twisting zone, and fluid supply means for conveying a fluid under pressure into said cylinder to act against the face of said piston to bias the free end thereof into operative contact with the adjacent surface of said one flexible member and thereby bias the same toward said other member at said twisting zone and nip the yarn advancing therethrough, and control means operatively associated with said biasing means for selectively substantially reducing the pressure of said fluid supply means acting upon said piston face, to thereby facilitate the thread-up of said apparatus by limiting the nipping force applied to the yarn, said control means including fluid reservoir means for cushioning the initial application of said fluid on said piston face, to thereby avoid the rapid application of a nipping force on the yarn upon the control means being actuated to return the pressure to its original value.

11. The yarn false twisting apparatus as defined in claim 10 wherein said control means further includes adjustable throttling valve means for controlling the flow rate of the fluid to said fluid reservoir means.

* * * * *

UNITED STATES PATENT AND TRADEMARK OFFICE

CERTIFICATE OF CORRECTION

PATENT NO. : 4,402,179

DATED : September 6, 1983

INVENTOR(S) : Peter Dammann, Benno Frank

It is certified that error appears in the above-identified patent and that said Letters Patent are hereby corrected as shown below:

Column 6, line 28, "twist" should be -- twisting --.

Column 6, line 49, "time" should be -- line --.

Signed and Sealed this

*Thirteenth* Day of *December 1983*

[SEAL]

*Attest:*

GERALD J. MOSSINGHOFF

*Attesting Officer*

*Commissioner of Patents and Trademarks*